US005219082A

United States Patent [19]

Daugherty, Jr. et al.

[11] Patent Number: 5,219,082

[45] Date of Patent: Jun. 15, 1993

[54] MALE CONNECTION MEMBER FOR AN ARTICULATED COUPLING ARRANGEMENT

[75] Inventors: David W. Daugherty, Jr., Bolingbrook; Wajih Kanjo, Lockport, both of Ill.; Michael G. Hawryszkow, Munster, Ind.; William D. Wallace, Chicago, Ill.; Edward G. Lynch, Jr., Saugus, Calif.

[73] Assignee: Westinghouse Air Brake Company, Wilmerding, Pa.

[21] Appl. No.: 586,524

[22] Filed: Sep. 21, 1990

[51] Int. Cl.[5] ..... B61G 5/00

[52] U.S. Cl. ..... 213/75 R; 105/3

[58] Field of Search ..... 105/3, 4.1, 4.2, 4.3; 213/74, 75 R; 280/492, 511; 403/143, 140, 135, 122; 384/208, 295, 296, 203, 204, 205, 206, 207, 209, 210, 211, 212, 213, 214

[56] References Cited

U.S. PATENT DOCUMENTS

| | | | |
|---|---|---|---|
| 1,067,892 | 2/1913 | Walters | 384/210 |
| 2,013,546 | 9/1935 | Wallace | 105/3 |
| 3,068,551 | 12/1962 | Cobb | 384/203 |
| 3,700,295 | 10/1972 | Butzow et al. | 384/210 |
| 4,095,856 | 6/1978 | Markovitz | 384/206 |
| 4,258,628 | 3/1981 | Altherr | 105/4 R |
| 4,336,758 | 6/1982 | Radwill | 105/4.1 |
| 4,593,829 | 6/1986 | Altherr | 213/75 R |
| 4,867,071 | 9/1989 | Weber | 105/4.1 |

FOREIGN PATENT DOCUMENTS

| | | | |
|---|---|---|---|
| 0657948 | 2/1963 | Canada | 384/206 |
| 0703249 | 3/1941 | Fed. Rep. of Germany | 384/206 |

OTHER PUBLICATIONS

Maintenance Manual for ASF Articulated Connection Assembly.

*Primary Examiner*—Mark T. Le

*Attorney, Agent, or Firm*—J. O. Ray, Jr.

[57] ABSTRACT

A male connection member utilized in an articulated coupling arrangement is provided by this invention. Such male connection member includes a first end portion engageable with and connectable to one end of a railway car to be connected in a semi-permanent manner. This male connection member has a second end portion formed integrally with such first end portion and disposed axially opposite thereof. The second end portion includes an outer end surface configured such that it will ensure that no contact will be made between such outer end surface and any other component of such articulated coupling arrangement. An aperture is formed through such second end portion to receive a bearing assembly therein. Such aperture has a longitudinal axis disposed transverse to a longitudinal axis of such male connection member and is in a substantially horizontal plane. A portion of such second end is adapted to enable securing such bearing assembly within such aperture formed in such male connection member.

19 Claims, 3 Drawing Sheets

MALE CONNECTION MEMBER FOR AN ARTICULATED COUPLING ARRANGEMENT

FIELD OF THE INVENTION

This invention relates, in general, to articulated coupling arrangements used to connect one end of a first railway car to an adjacent end of a second railway car in a substantially semi-permanent fashion and, more particularly, this invention relates to a male connection member which is adapted to carry a substantially spherical bearing assembly about which it rotates during in track service of such first and second railway cars coupled together by an articulated coupling arrangement.

BACKGROUND OF THE INVENTION

In today's modern railroad industry, it is well known that couplers are used to connect adjacent ends of a pair of railway cars together. On any of these railway cars which will possibly be used in interchange service, these standard couplers must have received approval by the Association of American Railroads (AAR) prior to their installation on such railway cars. It is generally well recognized that, in this application, such couplers are required to serve a number of functions in addition to facilitating the connection and disconnection of individual railway cars to and from, respectively, a train consist. One of these additional functions, for example, is to enable such individual railway cars to successfully negotiate the curved portions of a track encountered in the track structure. Additionally, such standard couplers enable such railway cars to be easily and readily combined so that a train consist can be made up. Further, when necessary, such couplers allow such railway cars to be readily separated into individual cars for either loading or unloading cargo thereto or therefrom, respectively.

However, in more recent times, it has come to be generally recognized in the railroad industry that a significant number of rather important advantages can be achieved by the interconnection of a number of railway cars to form a substantially semi-permanent unit. This is particularly the situation, for example, where such railway cars are specifically designed for use in what is known in the industry as "piggyback" or intermodal service. The reason for this is that the cargo to be either loaded or unloaded is brought to or removed from, respectively, predetermined locations. Such cargo is usually over-the-road trailers or large containers. The individual railroad cars which have been joined together in this substantially semi-permanent manner are commonly known in the railroad industry as a "10-pack". Except at the extreme outer ends of each 10-pack unit, these 10-pack units do not require the use of the standard couplers discussed above. The primary reason why such standard couplers are not required in this application is because of their dedicated service, these 10-pack units are broken only on a periodic basis. For example, in most cases, this will normally only occur when some maintenance must be carried out on either an individual coupler component or some other critical component positioned on the railway car which will require an individual car to be taken out of service on a temporary basis.

It has become obvious to the railroad industry that with the use of this semi-permanent coupling arrangement it is possible to achieve a significant reduction in costs. These cost reductions can be attributed to a variety of reasons. At a minimum, these reasons include a reduction in the weight of the equipment. Such weight reduction results in a significant reduction in energy requirements. In addition, because fewer railway trucks are required, this results in not only reduced equipment costs but also results in a reduction of maintenance requirements.

Now, however, with the rather extensive use of these semi-permanent coupling arrangements and with the ever increasing loads that must be carried by modern railway cars and train consists, the railroad industry and railway equipment suppliers have determined that it is of critical importance for a close-buttoned relationship to be maintained between the coupler draft components present in a particular coupling arrangement. Such close-buttoned relationship has been found necessary, for example, so that the detrimental effects of impact forces which are encountered during normal train operation can be reduced to an acceptable level. In this manner, damage incurred to both cargo and equipment can be held to an absolute minimum. Such impact forces are normally encountered during normal buff operations of the train.

With the above discussion in mind, attention is directed to one prior art type articulated coupling arrangement used for the purpose of connecting adjacent ends of a pair of railway cars together in such semi-permanent fashion. This prior art coupling device is taught in U.S. Pat. No. 4,258,628. As is shown therein, this particular articulated coupling apparatus includes a male connection member secured at one end thereof to one end of a first railway car body member and a female connection member which is secured at one end thereof to an adjacent end of a second railway car body member.

In this prior art coupling arrangement, the female connection member is rotatably engaged in a center plate bowl portion of the bolster member of the railway truck member. This rotatable type engagement is accomplished in a manner that is generally well known in the railway art. The male connection member is disposed for movement, at the outer end portion thereof, within a cavity located in the outer end portion of such female connection member. In this coupling arrangement, a pin member is utilized to connect both the male connection member and the female connection member together in such substantially semi-permanent fashion. This pin member is positioned in a vertical direction and is disposed in aligned apertures which are formed in each of such male connection member and such female connection member. It is important to note that, as is taught in this reference, the aperture formed in such male connection member for receiving the pin member therein must be formed somewhat larger than the pin member itself. This is necessary in this arrangement to enable certain movements required of the coupling apparatus to be achieved during in-track service. Additionally, it should be noted that a rear surface portion of such aperture formed in such male connection member and which will receive such pin member therein includes a horizontally disposed concave configuration and a vertically disposed convex configuration. This particular configuration is desirable so that both the male connection member and the female connection member can move in each of a horizontal direction and a vertical direction with respect to one another. At the same time, this configuration provides a rather substantial area of surface contact between the rear surface of the pin aperture and the pin member itself.

The outer end surface of the outer end portion of such male connection member includes a convex configuration which abuttingly engages a complimentary concave surface which is formed on a front face portion of a follower member. The follower member, in this coupling arrangement, is disposed within the rear portion of such cavity located in the outer end portion of such female connection member. The rear face portion of such follower member includes a pair of vertically-disposed slot-like cavities formed therein. A first portion of a resilient member is disposed within each of these vertical slot-like cavities. A second portion of each such resilient member extends outwardly from such rear face portion of such follower member. In this manner, a vertically disposed wedge-like element can be engaged with such exposed outer surface area of each such resilient element. Such wedge-like element being a necessary component of this coupling arrangement so that during service the follower member and the male connection member can be urged forward. Consequently, the rear surface portion of the aperture formed in the outer end of the male connection member is maintained substantially in contact with the pin member at all times.

Because most of the articulated connecting members used in this coupling arrangement are normally manufactured as cast components, such contact being maintained between the pin member and the rear surface portion of this aperture in the male connection member is essential. Furthermore, in order to maintain the production costs of this coupling apparatus as low as possible, such cast components will receive very little, if any, finish machining to provide either the necessary or the desirable dimensional control. These cast components, in other words, are generally used as cast. It is quite often difficult, as a result of this cost-saving practice, to provide an articulated coupling apparatus which will be self-adjusting under the various wear conditions which such coupling apparatus will normally encounter during operation. Nevertheless, it is important to minimize as much as possible the slack encountered in the various coupling connections during such in track service.

Other prior art coupling devices are taught in U.S. Pat. No. 3,716,146 and Canadian Patent Number 1,231,078.

SUMMARY OF THE INVENTION

The present invention provides a male connection member for use in an articulated type coupling arrangement which can be easily retrofitted to existing railway cars and is capable of connecting together, in a substantially semipermanent fashion, at least one predetermined end of a first railway car and an adjacent predetermined end of a second railway car. Such male connection member includes a first end portion having a predetermined configuration. This predetermined configuration of such first end portion is such that it will enable the male connection member to be engaged with and connected to a predetermined end of a center sill member disposed substantially along a longitudinal centerline of a railway car to be connected in such semipermanent manner. The male connection member has a second end portion formed integrally with such first end portion. This second end portion has a predetermined size and a predetermined shape and is disposed substantially axially opposite such first end portion of the male connection member. Such second end portion includes an outer end surface having a predetermined configuration. The predetermined configuration of this outer end surface is such that it will ensure that no contact will be made between the outer end surface and other components of such articulated type coupling arrangement. An aperture, having a predetermined size and a predetermined shape, is formed through a predetermined portion of such second end portion of the male connection member. A longitudinal axis of this aperture is disposed transverse to a longitudinal axis of such male connection member. Additionally, this longitudinal axis of such aperture is disposed in a substantially horizontal plane. The male connection member also has a means disposed on such second end portion thereof adjacent an outer edge of such aperture which enables a bearing assembly to be secured to such second end portion. Such male connection member being rotatable about such bearing assembly.

OBJECTS OF THE INVENTION

It is, therefore, one of the primary objects of the present invention to provide a male connection member for use in an articulated type coupling arrangement which is subjected to very little wear during operation in a train consist.

Another object of the present invention is to provide a male connection member for use in an articulated type coupling arrangement which will require a minimum of maintenance.

Still another object of the present invention is to provide a male connection member for use in an articulated coupling arrangement which is relatively inexpensive to manufacture.

A further object of the present invention is to provide a male connection member for use in an articulated coupling arrangement which can be cast as an integral single piece unit.

It is an additional object of the present invention to provide a male connection member for use in an articulated type coupling arrangement which can be easily retrofitted to existing railway cars.

Another object of the present invention is to provide a male connection member for use in an articulated type coupling arrangement which can be used with a number of differently designed female connection members.

Still another object of the present invention is to provide a male connection member for use in an articulated type coupling arrangement which will be cost effective for the railroad industry.

Yet another object of the present invention is to provide a male connection member for use in an articulated coupling arrangement which is relatively light weight.

A still further object of the present invention is to provide a male connection member for use in an articulated type coupling arrangement which can accommodate a number of differently designed race assemblies that forms a part of the bearing assembly.

It is an additional object of the present invention to provide a male connection member for use in an articulated coupling arrangement which can accommodate a bearing assembly disposed substantially along a horizontal axis.

In addition to the above-described objects and advantages of the male connection member utilized in an articulated type coupling arrangement, various other objects and advantages of the present invention will become more readily apparent to those persons who are skilled in the railroad coupling art from the following more detailed description of the invention, particularly when such description is taken in conjunction with the attached drawing figures and with the appended claims.

BRIEF DESCRIPTION OF THE INVENTION

Figure 1:
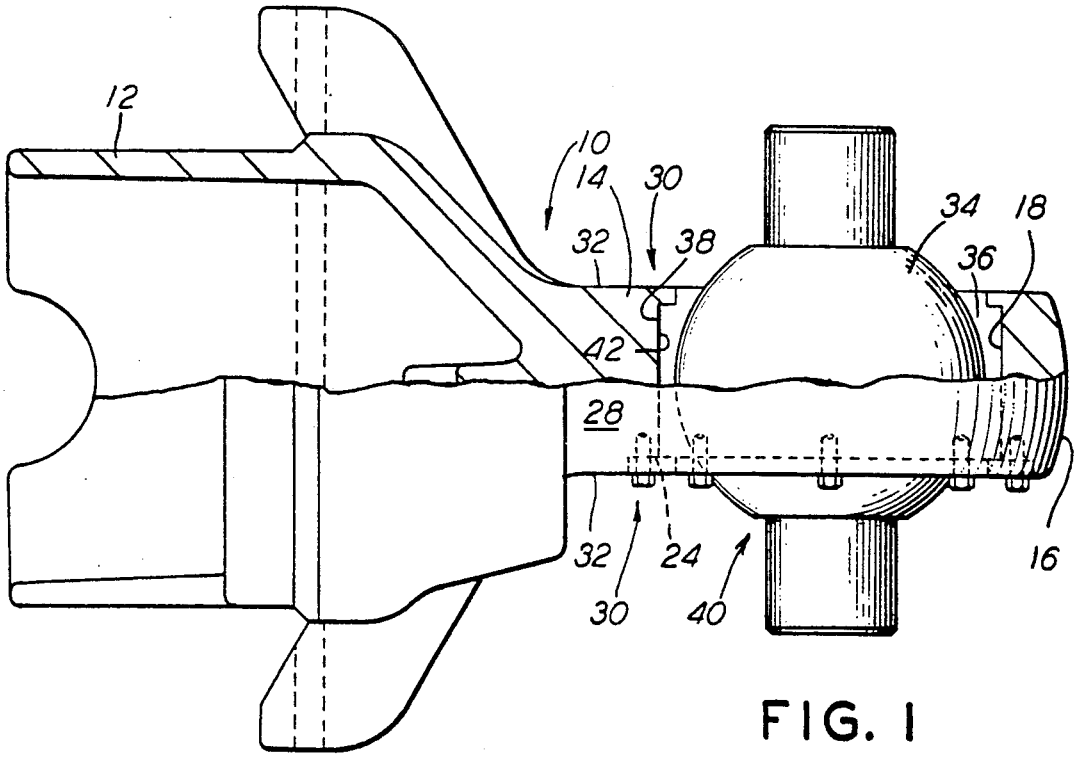
FIG. 1 is a top view, partially in cross-section, which illustrates one presently preferred embodiment of a male connection member for use in an articulated type coupling arrangement and having a bearing assembly secured thereto.

Prior to proceeding to the more detailed description of the instant invention, it should be noted that in each of the several views illustrated in the drawings, identical components which have identical functions have been identified, for the sake of clarity, with identical reference numerals.

The present invention can be used in conjunction with the articulated type coupling arrangements taught in our co-pending and earlier filed U.S. patent application having serial numbers 07/520686 (U.S. Pat. No. 5,131,331) and 07/520,687 (U.S. Pat. No. 5,065,679), filed on May 8, 1990. The disclosure in such co-pending U.S. patent applications being incorporated herein by reference thereto.

Figure 2:
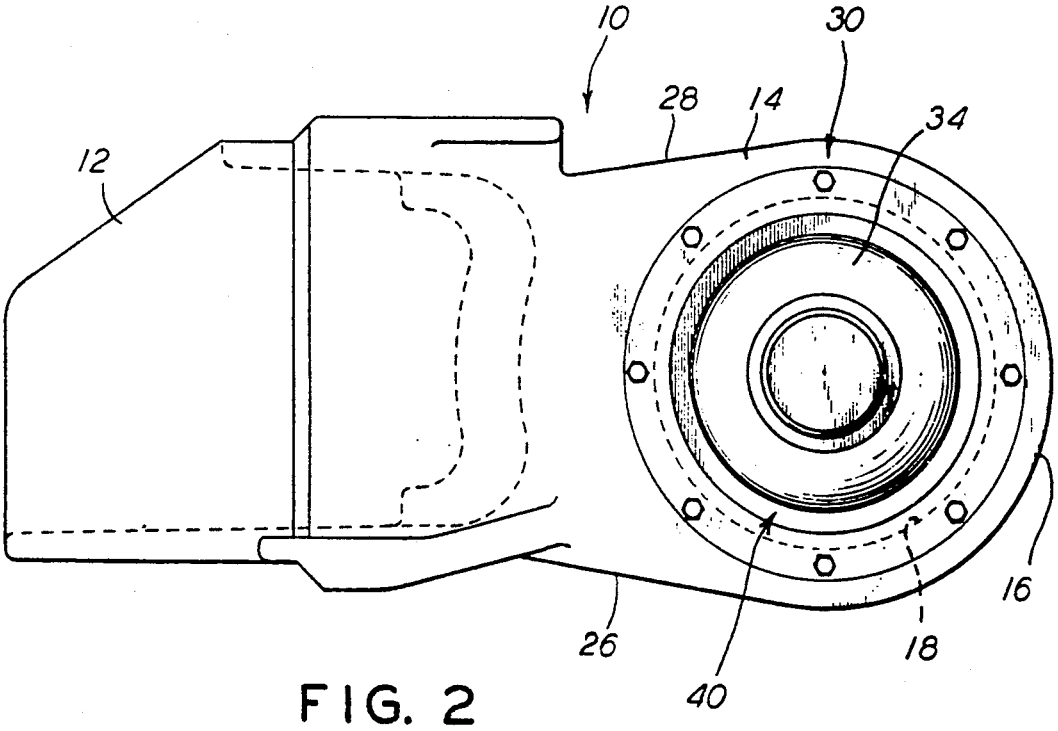
FIG. 2 is a side elevation view, partially in cross-section, of the male connection member illustrated in FIG. 1.

Reference is now made to FIGS. 1 and 2 in which the male connection member, generally designated 10, constructed according to a presently preferred embodiment of the invention, is illustrated. This male connection member 10 is useful in an articulated type coupling arrangement (not shown) and can be rather easily retrofitted to existing railway cars as well as being easily installed on new cars when they are built. An articulated type coupling arrangement as taught in our co-pending application referenced above is capable of connecting together, in a substantially semi-permanent manner, at least one predetermined end (not shown) of a first railway car (not shown) and an adjacent predetermined end (not shown) of a second railway car (not shown). The male connection member 10 includes a first end portion 12 having a predetermined configuration. Such predetermined configuration of such first end portion 12 enables the male connection member 10 to be engaged with and connected to a predetermined end (not shown) of a center sill member (not shown). Such center sill member is disposed substantially along a longitudinal centerline of a railway car to be connected in such semipermanent fashion.

Additionally, the male connection member 10 includes a second end portion 14 having a predetermined size and a predetermined shape. Such second end portion 14 is preferably formed integrally with the first end portion 12 and it is disposed substantially axially opposite such first end portion 12. The second end portion 14 includes an outer end surface 16 which has a predetermined configuration. This predetermined configuration of the outer end surface 16 is such that it will ensure that no contact between the outer end surface 16 of such second end portion 14 and other components (not shown) of such articulated type coupling arrangement will occur. An aperture 18 is formed through a predetermined portion of such second end portion 14 of this male connection member 10. Such aperture 18 has a predetermined size and a predetermined shape. A longitudinal axis of such aperture 18 is disposed transverse to a longitudinal axis of such male connection member 10. Further, such longitudinal axis of such aperture 18 is positioned in a substantially horizontal plane.

Further, the male connection member 10 includes a means, generally designated 30, formed in such second end portion 14 adjacent an outer edge 24 of the aperture 18 which enables a bearing assembly, generally designated 40, to be secured in place to the second end portion 14 of the male connection member 10.

According to the presently preferred embodiment of this invention, the first end portion 12 and the second end portion 14 of the male connection member 10 will be formed integrally as a simple piece casting. For the purposes of economy in manufacturing, such aperture 18 will be cast into the second end portion 14 at the same time. In most instances it will be preferred for such aperture 18 to be cast as a substantially round opening even though other shapes would be within the scope of the invention.

It is desirable for the outer end surface 16 of the second end portion 14 to have a substantially convex configuration in at least one of a horizontal direction and a vertical direction. It is even more preferred for this outer end surface 16 to be substantially convex in both such horizontal direction and such vertical direction.

The predetermined configuration of the second end portion 14 preferably includes a tapered portion of a bottom wall surface 26 which extends upwardly from the outermost end 16 thereof and inwardly towards the first end portion 12. If desired, this predetermined configuration may also include a tapered portion of the top wall surface 28 which extends downwardly from such outermost end 16 of the second end portion 14 towards the first end portion 12 of the male connection member 10. This may be desirable, for example, to reduce the total weight of such male connection member 10. As part of the preferred configuration of the second end portion 14, the side wall portions 32 will be substantially parallel to one another. The first end portion 12 will have a configuration, at least in the area where it will be engaged with and connected to the center sill member, that is substantially rectangular in cross-section.

Figure 3:
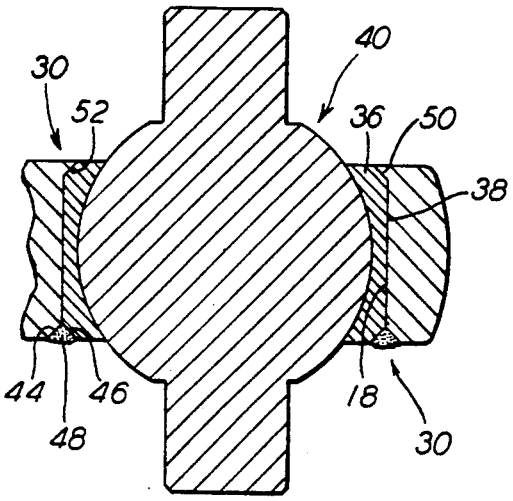
FIG. 3 is a cross-sectional view which illustrates an alternative means for securing the bearing assembly into such male connection member.
Figure 4:
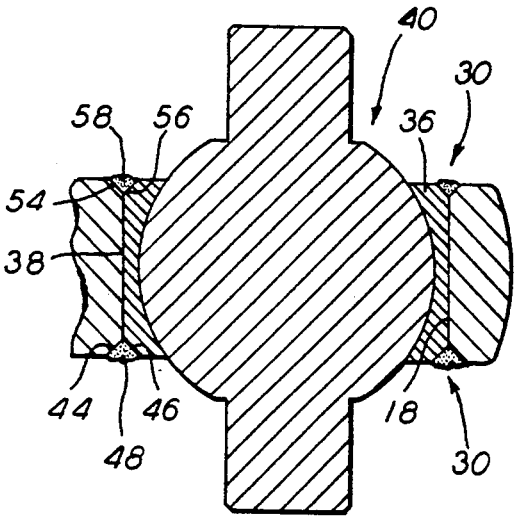
FIG. 4 is a cross-sectional view which illustrates another alternative means for securing such bearing assembly to such male connection member.
Figure 5:
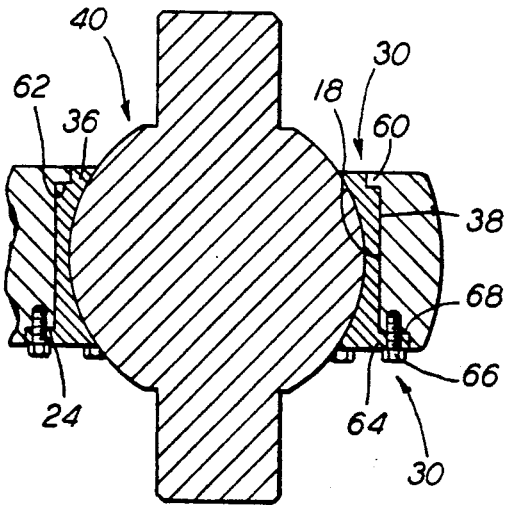
FIG. 5 is a cross-sectional view which illustrates another alternative means for securing such bearing assembly to such male connection member.
Figure 6:
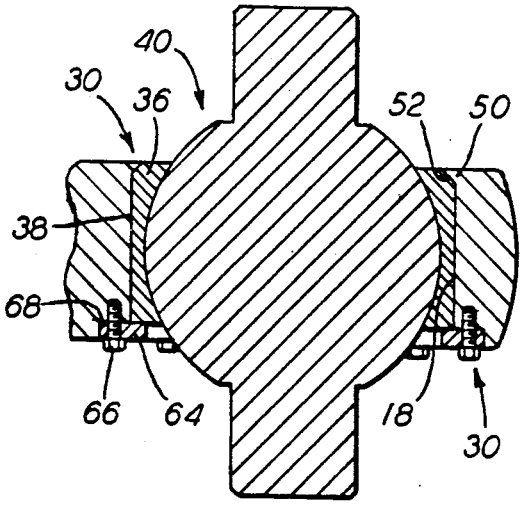
FIG. 6 is a cross-sectional view which illustrates another alternative means for securing such bearing assembly to such male connection member.
Figure 7:
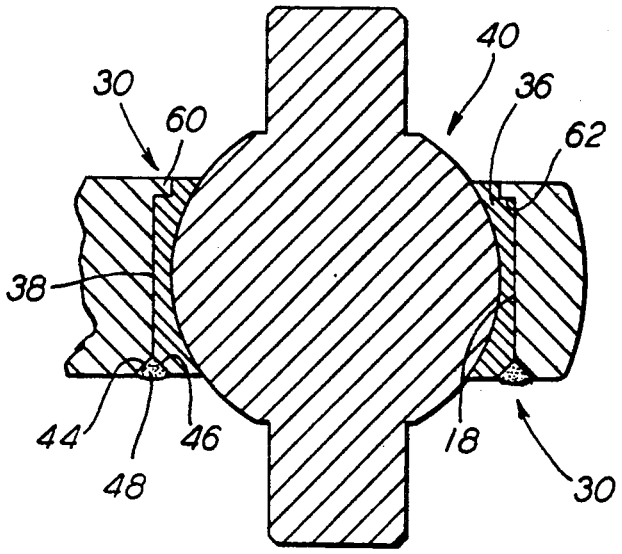
FIG. 7 is a cross-sectional view which illustrates another alternative means for securing such bearing assembly to such male connection member.

Now referring more particularly to FIGS. 3 through 8 it can be seen that the bearing assembly 40 includes a substantially spherical member 34. At least a portion of the spherical member 34 is disposed within a race assembly 36. The outer surface 38 of such race assembly 36 is substantially identical in size and shape as an inner surface 42 of the aperture 18. If, for some reason, it is desirable to secure the bearing assembly 40 into the aperture 18 in a substantially permanent manner, such as by welding, the means 30 provided to accomplish this will include at least one beveled portion 44 adjacent at least one predetermined outer surface of the aperture 18. In this case, an adjacent outer edge surface of the race assembly 36 will also include a beveled portion 46 so that weld metal 48 can be applied to hold the race assembly 36 within the aperture 18 of such male connection member 10. As illustrated in FIGS. 3, 4 and 7, the beveled portion 44 is tapered downwardly from an outer side surface of the second end portion 14 of such male connection member 10 and inwardly toward the peripheral surface of the aperture 18 formed therein. At the same time, the beveled portion 46, disposed on the outer edge of the race assembly 36 is tapered downwardly from an outer side surface thereof, which is in substantially the same plane as the outer side surface of the second end portion 14, and inwardly toward such peripheral surface of such aperture 18. In this welding arrangement, there are a number of ways to secure the axially opposed sides of the race assembly 36 to the aperture 18. For example, FIG. 3 illustrates another beveled portion 50, disposed on the second end 14 of the male connection member 10, which is abuttingly engaged with another beveled portion 52 disposed on the race assembly 36. Such beveled portion 50 is tapered inwardly from the outer side surface of the second end portion 14 and downwardly toward such aperture 18 disposed therein. FIG. 4 illustrates welding of such axially opposed side of the race assembly 36 to the second end portion 14 of the male connection member 10 adjacent the aperture 18. In this case, the second end portion 14 includes a beveled portion 54 which is tapered downwardly from another outer side surface of the second end portion 14 and inwardly toward such peripheral surface of such aperture 18. The race assembly, in this case, includes a beveled portion 56, which is tapered downwardly from an outer side surface of such race assembly 36, which is in substantially the same plane as such another outer side surface of the second end portion 14, and inwardly toward such peripheral surface of the aperture 18 so that weld metal 58 can be applied to hold the race assembly 36 securely in place within the aperture 18. Finally, as shown in FIG. 7, in this welding arrangement, the axially opposed sides of the race assembly 36 can be held in place by a ledge member 60 disposed on one of the second end portion 14 adjacent such aperture 18 engaged with a complimentary recessed portion 62 disposed on the race assembly 36. It should be obvious that the ledge member could be part of the race assembly 36 and the recessed portion 62 could be on the second end portion 14 of the male connection member 10.

Figure 8:
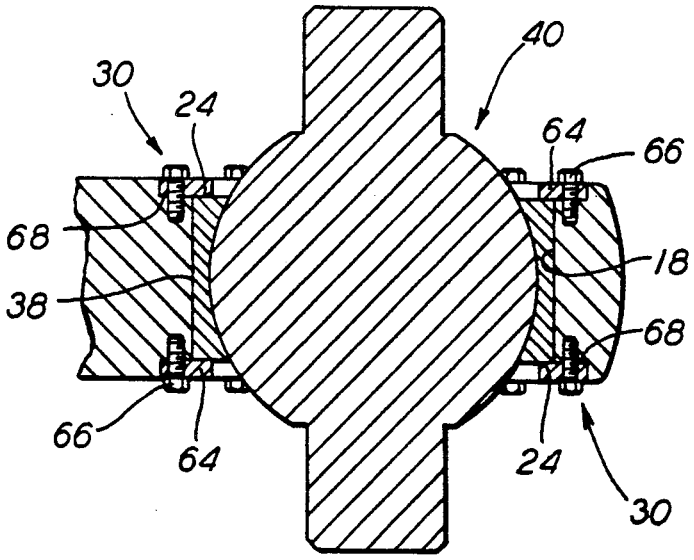
FIG. 8 is a cross-sectional view which illustrates another alternative means for securing such bearing assembly to such male connection member.

FIGS. 5, 6 and 8 illustrate arrangements for removably securing such race assembly 36 to such aperture 18 in the second end portion 14 of the male connection member 10. As shown in FIG. 5, a ledge portion 60, disposed on the second end portion 14, extends into the aperture 18. Such ledge portion 60 abuttingly engages a recess 62 formed on an outer surface of the race assembly 36 for securing one side of the race assembly 36 within the aperture 18. The opposed other side of the race assembly 36 is secured in the aperture 18 by means of a plate-like member or flange 64 secured to the second end portion 14 of the male connection member 10 by bolts 66. Preferably the plate-like member 64 includes a first portion disposed in a recess or flange seat 68 formed on the second end portion 14 and a second end portion of the plate-like member 64 is disposed in a recess formed on the race assembly 36. In this arrangement, it should be obvious that instead of the plate-like member 64 a ledge could be formed on the race assembly which could be bolted to such a second end portion 14 of the male connection member 10.

FIG. 6 illustrates using a combination including features illustrated in FIGS. 3 and 8. FIG. 8 illustrates the use of two-plate like members 64.

While a number of presently preferred and alternative embodiments of the male connection member and the means for securing a bearing assembly have been described in detail above, it should be obvious to those persons who are skilled in the railway coupling art, that various other modifications and adaptations of the present invention can be made without departing from the spirit and scope of the appended claims.

We claim:

1. A male connection member for use in an articulated type coupling arrangement which can be easily retrofitted to existing railway cars and is capable of connecting together, in a substantially semipermanent manner, at least one predetermined end of a first railway car and an adjacent predetermined end of a second railway car, said male connection member comprising:

a. a first end portion having a predetermined configuration, said predetermined configuration of said first end portion enabling said male connection member to be engaged with and connected to a predetermined end of a center sill member disposed substantially along a longitudinal center line of a railway car to be connected in such semi-permanent manner; and b. a second end portion, having a predetermined size and predetermined configuration, formed integrally with said first end portion and disposed axially opposite thereof, said second end portion of said male connection member including:

i. a top wall surface, an end wall surface and a bottom wall surface interconnected to form a continuous outer surface having a predetermined configuration which ensures no-contact with any other component when said male connection member is positioned in its operative position in the articulated type coupling arrangement;

ii. an aperture, having a predetermined size and predetermined shape, formed through a predetermined portion of said second end portion of said male connection member, said aperture having a longitudinal axis that is disposed transverse to a longitudinal axis of said male connection member and is in a substantially horizontal plane; and iii. said bottom wall surface extending upwardly from a lowest portion of the bottom wall surface and inwardly from said lowest portion towards said first end portion; and c. a means formed in said second end portion adjacent an outer edge of said aperture for enabling a bearing assembly to be secured to said second end portion of said male connection member.

2. A male connection member, according to claim 1, wherein said first end portion and such second end portion of said male connection member are formed integrally as a single piece casting.

3. A male connection member, according to claim 2, wherein said aperture is cast into said single piece casting.

4. A male connection member, according to claim 1, wherein said predetermined shape of said aperture is substantially round.

5. A male connection member, according to claim 1, wherein said end wall surface of said second end portion is substantially convex in at least one of a horizontal direction and a vertical direction.

6. A male connection member, according to claim 5, wherein said end wall surface of said second end portion is substantially convex in both said horizontal direction and said vertical direction.

7. A male connection member, according to claim 1, wherein said means for enabling such bearing assembly to be secured to said second end portion of said male connection member includes a ledge portion extending inwardly toward a center of said aperture adjacent a predetermined outer surface.

8. A male connecting member, according to claim 1, wherein said top wall surface extends downwardly from an uppermost portion of said top wall surface and inwardly from said uppermost portion towards said first end portion.

9. A male connecting member, according to claim 6, wherein said top wall surface extends downwardly from an uppermost portion of said top wall surface and inwardly from said uppermost portion towards said first end portion.

10. A male connection member, according to claim 9, wherein said predetermined configuration of said second end portion includes a pair of substantially parallel side wall portions.

11. A male connection member, according to claim 1, wherein said predetermined configuration of said first end portion is substantially rectangular in cross-section.

12. A male connection member, according to claim 1, wherein said means for enabling such bearing assembly to be secured to said second end portion of said male connection member includes a beveled portion adjacent at least one predetermined outer surface of said aperture.

13. A male connection member, according to claim 12, wherein said means for enabling such bearing assembly to be secured to said second end portion of said male connection member includes a pair of beveled portions, a first of said pair of beveled portions positioned adjacent a first outer surface of said aperture and a second of said pair of beveled portions positioned adjacent a second outer surface of said aperture.

14. A male connection member, according to claim 13, wherein one of said pair of beveled portions extends inwardly toward said aperture and another of said pair of beveled portions extends outwardly from said aperture and said means for enabling such bearing assembly to be secured to said second end portion of said male connection member includes a weldment adjacent said another of said pair of beveled portions.

15. A male connection member, according to claim 13, wherein each of said pair of beveled portions extends outwardly from said aperture and said means for enabling such bearing assembly to be secured to said second end portion of said male connection member includes a weldment adjacent said each of said pair of beveled portions.

16. A male connection member, according to claim 12, wherein said beveled portion extends inwardly toward said aperture and said means for enabling such bearing assembly to be secured to said second end of said male connection member further includes a recessed portion adjacent another predetermined outer surface of said aperture.

17. A male connection member, according to claim 12, wherein said means for enabling such bearing assembly to be secured to said second end of said male connection member further includes a recessed portion adjacent an outer surface axially opposed to said predetermined outer surface.

18. A male connection member, according to claim 7, wherein said means for enabling such bearing assembly to be secured to said second end of said male connection member further includes a recessed portion adjacent an outer surface axially opposed to said predetermined outer surface.

19. A male connection member, according to claim 18, wherein said means for enabling such bearing assembly to be secured to said second end portion of said male connection member further includes a predetermined plurality of threaded apertures spaced about a periphery of said aperture.

* * * * *

UNITED STATES PATENT AND TRADEMARK OFFICE

CERTIFICATE OF CORRECTION

PATENT NO. : 5,219,082

DATED : June 15, 1993

INVENTOR(S) : DAVID DAUGHERTY, JR. et al.

It is certified that error appears in the above-identified patent and that said Letters Patent is hereby corrected as shown below:

Column 3, line 54, insert -- - -- between semi permanent
column 6, line 3, insert -- - -- between semi permanent
column 8, line 49, insert --a-- after and Signed and Sealed this First Day of March, 1994

*Attest:*

*Attesting Officer*

BRUCE LEHMAN

*Commissioner of Patents and Trademarks*